United States Patent [19]

Kime

[11] Patent Number: 4,643,258

[45] Date of Patent: Feb. 17, 1987

[54] PUMP APPARATUS

[76] Inventor: James A. Kime, 5360 Godown Rd., Columbus, Ohio 43220

[21] Appl. No.: 732,850

[22] Filed: May 10, 1985

[51] Int. Cl.[4] ..... F04B 47/04

[52] U.S. Cl. ..... 166/369; 166/68; 166/105.5; 417/435

[58] Field of Search ..... 166/369, 370, 68, 68.5, 166/105.5, 105.6; 417/435, 400, 401

[56] References Cited

U.S. PATENT DOCUMENTS

| | | | |
|---|---|---|---|
| 2,363,343 | 11/1944 | Lindgren | 417/435 |
| 2,837,029 | 6/1958 | Mohnkern | 417/400 |
| 3,372,753 | 3/1968 | Tuttle | 166/370 |
| 3,594,103 | 7/1971 | Hillis | 166/105.6 |
| 4,480,685 | 11/1984 | Gilbertson | 166/68.5 |
| 4,557,668 | 12/1985 | Jones | 417/435 |

*Primary Examiner*—Stephen J. Novosad
*Assistant Examiner*—William P. Neuder
*Attorney, Agent, or Firm*—Mueller and Smith

[57] ABSTRACT

Pump apparatus and method in which gaseous fluids that develop in the pumping chamber of a down hole pump can be removed during normal operation of the device to prevent gas-lock and to avoid having to force gases up the tubing string.

18 Claims, 5 Drawing Figures

PUMP APPARATUS

BACKGROUND OF THE INVENTION

The production of crude oil from a formation involves a broad range of techniques and equipment. One such production technique is that of using a "down hole" pump submerged in a well containing formation fluid which is reciprocatively driven to lift the fluid through a tubing string to the well head from where it is piped to separation and storage facilities. Classically, a walking beam and more recently an improved hydraulic stroking device at the surface reciprocates the pump.

In a gas driven formation the formation fluid generally includes a mixture of water, oil, free gas, and gas which has been forced into solution by formation pressure. As pumping of the well occurs, formation pressure may be gradually reduced. Because of this reduced formation pressure and pressure changes occurring within the pump, outgassing of some of the gas in solution can occur as the formation fluid enters the pump. This outgassed fluid may combine with free gas in the mixture to form a pocket of gas in the pump. For the pump to continue to function, such gas must be pumped up the tubing string with the liquid portion of the formation fluid. However, in order for the gas to move into the tubing string, it must be compressed to the pressure of the fluid in the tubing string which can be over 2,000 psi. Because pumps submerged in wells operate under adverse conditions which necessitate relatively large clearances between moving parts and which militate against using seals between moving parts, they are inefficient gas compressors. In consequence the pumps often become gas-locked, i.e., they continue to reciprocate back and forth but with no pumping effect. The gas pocket cannot be compressed to the extent it can be pumped up the tubing string and the pressure in the pump cannot be lowered to a state wherein more fluid can be drawn into the pump to displace the gas pocket.

A gas locked pump remains in that locked state until formation pressure builds back up to where more fluid can be forced into the pump and the gas pocket can be displaced up the tubing string. Most producers using conventional walking beam stroking devices cannot detect a gas locked pump. Consequently, the pump may be operated for long periods of time in a gas locked state. Operating a pump in such a state results in wasted energy, reduced production, and additional wear of the pump and stroking device.

To reduce gas lock, manufacturers have attempted to achieve higher gas compression efficiencies. This has resulted in more elaborate pumps. Furthermore, when gas can be pumped up the tubing string, the resulting liquid-gas mixture at the well head may be a foam that resembles a "dirty milkshake". When the gas in this foam dissipates, only a small volume of liquid remains. The volume of this liquid may be as little as 10 percent of the pumped fluid. Thus, the amount of liquid produced at the well head may be only 10 percent of the volume of fluid pumped. Obviously, the efficiency of the pumping process is seriously degraded when gas is pumped up the tubing string.

Using a hydraulic stroking device rather than a walking beam stroking device, a capability has been realized for monitoring the performance of an operating pump. Thus, it has been found possible to detect gas pockets in a pump. Investigations have determined that reducing the stroking rate of the pump substantially eliminates gas in the pump and greatly increases the efficiency of the pumping process. Unfortunately, when this lower stroking rate technique has been employed, production has fallen to unacceptable levels.

In view of the foregoing, it will be appreciated that the stroking rate of the pump will be an important factor in any solution to the problem of gas occurring in a pump operating in a well in a gas driven formation, e.g., the Clinton formation. Such solution preferably will solve the problem of gas in a pump in such a manner that gas will not have to be pumped up the tubing string.

SUMMARY

The present invention is addressed to a pumping system and method in which gaseous fluids that develop in the pumping chamber of a down hole pump can be removed during normal operation of the device. This system greatly enhances the efficiency of the process for pumping formation fluid containing gases because gas lock of the pump can be eliminated and because developed gases do not have to be forced up the tubing string. Furthermore, the removed gaseous fluids can be easily recovered at the well head for subsequent use or distribution.

A further feature of the invention is to provide a gas-oil well production system for pumping formation fluid. Such a system includes a pump having a barrel with a barrel fluid inlet, a barrel fluid outlet, a barrel chamber, and a plunger mounted in the barrel chamber. The plunger has a plunger chamber and is reciprocally driven between an upper terminal position at the end of the plunger up stroke and a lower terminal position at the end of the plunger downstroke. The method for removing developed gaseous fluids in the formation fluid from the barrel chamber comprises the steps of drawing formation fluid into the barrel chamber during the plunger upstroke and providing a gas port means in the barrel. The method further includes the steps of expelling the developed gaseous fluids from the barrel chamber through the gas port means during the occurrence of that portion of the plunger downstroke from the upper terminal position toward the gas port means and blocking the gas port means and moving formation fluid into the plunger chamber during the occurrence of that portion of the plunger downstroke from below the gas port means to the lower terminal position.

Another feature of the invention is to provide a gas-oil production system in which a down hole pump is operated by a surface stroking device to lift formation fluid in a well through a tubing string. This system includes a barrel having a barrel wall, a barrel fluid inlet, and a barrel fluid outlet connectable in fluid communication with the tubing string. The system further includes a plunger mounted in a barrel chamber which is defined by the barrel wall, the barrel fluid inlet, and the barrel fluid outlet. Means are provided for connecting the plunger to the surface stroking device whereby the plunger is driven between an upper terminal position at the end of the plunger upstroke and a lower terminal position at the end of the plunger downstroke. Gas port means are provided in the barrel between the barrel fluid inlet and the barrel fluid outlet. Such gas port means are spaced from the plunger when the plunger is at the upper terminal position so as to establish a degassing zone wherein developed gaseous fluids in the formation fluid are collected between the plunger and the gas port means. The developed gaseous fluids are expelled from the degassing zone during that portion of the plunger downstroke from the upper terminal position to the gas port means.

A further feature of the invention is to provide a down hole pump for lifting fluid in a well which comprises a barrel having a wall, a fluid inlet, and a fluid outlet which cooperate to define a barrel chamber. The pump includes a plunger mounted for reciprocation in the barrel chamber and movable between an upper terminal position at the end of the plunger upstroke and a lower terminal position at the end of the plunger downstroke. Gas port means are provided in the barrel between the barrel inlet and the barrel outlet.

Other features of the invention will, in part, be obvious and will, in part, appear hereinafter. The invention, accordingly, comprises the method and apparatus possessing the construction, combinations of elements and steps, and arrangement of parts, which are exemplified in the following detailed description.

For a fuller understanding of the nature and objects of the invention, reference should be had to the following detailed description taken in conjunction with the accompanying drawings.

DETAILED DESCRIPTION OF THE INVENTION

Figure 1:
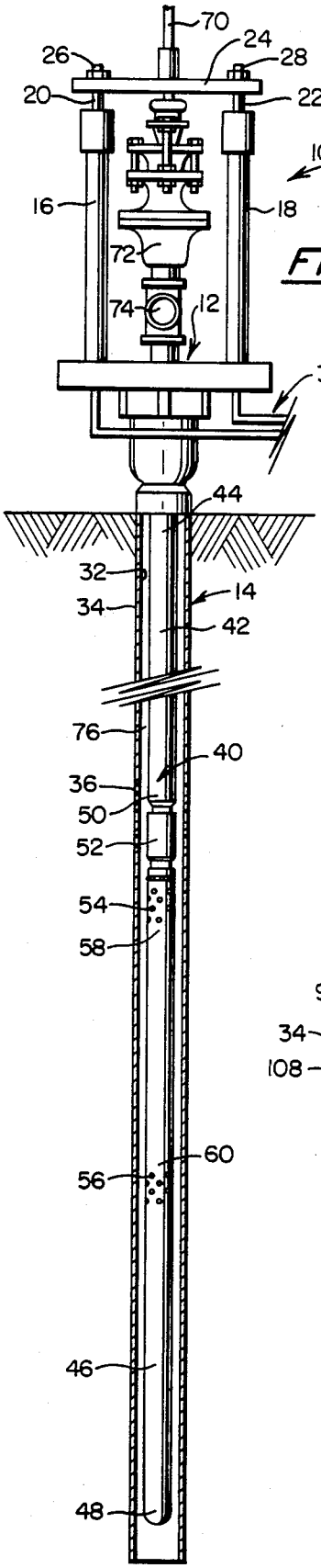
FIG. 1 is a partial sectional view illustrating the pump apparatus of the invention mounted in a well and operated by a surface stroking device.

The apparatus and method of the invention are used in a well drilled into a gas driven formation which lacks sufficient pressure to drive the formation fluid to the well head. This apparatus is operated by a stroking device located on the terrestrial surface. An overall picture of the pump apparatus in its operating environment is shown in FIG. 1. A portion of a hydraulic stroking device 10 is mounted adjacent a well head 12 which provides surface control of a well 14. Stroking device 10 includes two hydraulic cylinders 16 and 18 which have extensible and retractable piston rods 20 and 22, respectively. These cylinders 16 and 18 are connected in a drive arrangement by a horizontally extending yoke plate 24 which is attached to the outer ends 26 and 28 of piston rods 20 and 22. Piston rods 20 and 22 and yoke plate 24 are reciprocted when hydraulic pressure fluid from a source, not shown, is supplied alternately to one end of cylinders 16 and 18 through a conduit 30 to extend piston rods 20 and 22 from cylinders 16 and 18 and raise yoke plate 24 and to the opposite end of cylinders 16 and 18 to retract piston rods 20 and 22 and lower yoke plate 24.

Well 14 (broken away and enlarged to show the pump apparatus at the bottom of the well) includes a hole 32 drilled in the terrestrial surface to a depth below the upper level of a formation (not shown). As an example, the Clinton formation in northeastern United States exhibits this formation at depths between 2,800 and 5,500 feet. A casing 34 is inserted in hole 32 to provide a rigid side wall for well 14. Openings 36 are formed in the lower portion of casing 34 by conventional methods, i.e., controlled explosion to permit formation fluid to flow into well 14. This fluid rises to a level at which the hydrostatic pressure of the fluid column equals formation pressure, that being the pressure exerted on the fluid in the formation by natural gas or water. In a well drilled into a gas driven formation, the formation fluid is a complex mixture of oil, water, free gas, and dissolved gases termed "light ends". These light ends constitute the volatile fractions of the formation. They are maintained in solution in the mixture because of formation pressure if the mixture is in the formation or because of the hydrostatic pressure of the fluid column if the mixture is in the well 14.

Production apparatus is installed in well 14 as is represented generally at 40. This apparatus 40 comprises a tubing string 42 which includes a plurality of tubular sections which are successively coupled together by threaded connections to extend into well 14 to provide a fluid conduit for the pumped fluid. The upper end 44 of tubing string 42 is secured to well head 12 through a conventional arrangement of hangers and seals. A mud anchor 46, which has a closed end 48, is connected to the lower portion 50 of tubing string 42 by a seating collar 52. Mud anchor 46 is seen to be located in the bottom of well 14 below the openings 36 in casing 34 which admit formation fluid to well 14 and thus, is submerged in the fluid. This location of mud anchor 46 is atypical. In most wells, the production apparatus is installed such that the mud anchor will be located above the openings which admit formation fluid to the well.

Two groups of bores depicted generally at 54 and 56 are drilled in the side wall of mud anchor 46. Bore grouping 54 is located in the upper portion 58 of mud anchor 46 while bore grouping 56 is located in the middle portion 60 of the device. Formation fluid enters mud anchor 46 through both bore groupings 54 and 56. Conventional mud anchors only have one set of bores, these being located generally in the upper portion thereof, which admit formation fluid.

Positioned within mud anchor 46 is a long, narrow pumping device which is reciprocally driven from stroking device 10. Reciprocal drive communication between device 10 at the well head 12 and the plunger of the pumping device is provided by an elongated rod string. Such a rod string is made up of an assembly of long, slender metal rods, which are successively coupled together by threaded connections. The uppermost component of the rod string, termed a "polish rod", is revealed at 70. Such a rod 70 has a machined outer surface and an upper end which projects upwardly through a stuffing box 72 mounted in well head 12 and is drivingly connected to yoke plate 24. The lowermost component of the rod string is rigidly connected to the plunger of the pumping device. Consequently, as stroking device 10 operates to reciprocate yoke plate 24, the rod string simultaneously reciprocates the pump plunger within the pumping device to thereby pump formation fluid through tubing string 42 to well head 12. The pumped fluid which reaches the surface of well 14 will exit well head 12 through a conduit 74 which is connected to a collection system, not shown, that provides the conventional functions of oil, gas and water separation and storage.

Owing to the dynamics of pump action, movement of yoke plate 24 does not instantaneously cause corresponding movement of the pump plunger. For the most part, a significant lag in pump reaction occurs. This is due to the fact that as the plunger moves upwardly in the pump it lifts the fluid column in the tubing string and the rod string is stressed by the weight of the fluid column. Therefore, the rod string exhibits strain (stretch) which must be accommodated by movement of yoke plate 24 before the plunger can move. Similarly, when the plunger moves downwardly in the pump, the weight of the fluid column in the tubing string is transferred from the rod string to the tubing string. This causes the rod string to recover or contract. Therefore, the distance the rod string contracts must be accommodated by downward movement of yoke plate 24 before the plunger can move.

After well 14 has been pumped for a period of time, formation pressure will begin to fall and the fluid column in casing 34 gradually will lower until, ultimately, the well is pumped off. As the fluid column in casing 34 lowers, hydrostatic pressure acting on the fluid mixture in well 14 is reduced. Consequently, when this fluid mixture enters the pump and the pressure is further reduced by the pumping action some of the light ends are outgassed from the mixture. These light ends can combine with free gas in the mixture to form a gas pocket. With the method of this invention, degassing of the fluid will be seen to occur on the downward stroke of the pump plunger. Gases or other fluids which are removed from the pump by the pump process are vented through bore grouping 54 in the upper portion 58 of mud anchor 46 to an annular chamber 76 between casing 34 and tubing string 42 through which the free gases can rise to the well head 12. It may be recalled that bore grouping 54 is located below openings 36 which admit formation fluid into casing 34 and above bore grouping 56 which admits formation fluid into the pump apparatus. Consequently, the vented gas moves upwardly and commingles with formation fluid moving downwardly towards bore grouping 56 and the middle portion 60 of mud anchor 46. This commingling accentuates further degassing of the formation fluid.

Figure 2:
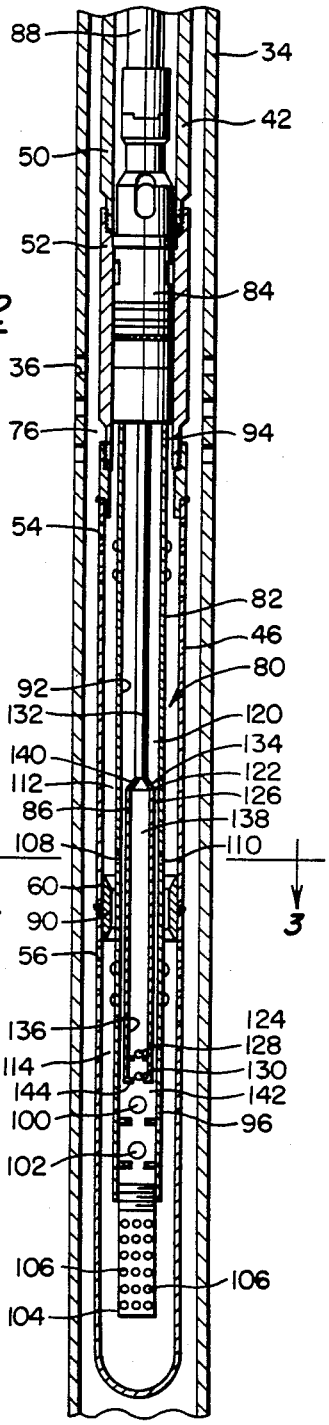
FIG. 2 is an enlarged sectional view of FIG. 1 showing formation fluid being drawn into the pump apparatus of the invention.

More specific details of the pumping device positioned in mud anchor 46 can be seen in FIG. 2. It may be observed that a rod pump 80 generally includes a barrel 82 connected to the lower portion of tubing string 42 by a mounting assembly 84. A plunger 86 is connected to lowermost component of rod string 88 for reciprocation therewith within barrel 82. Barrel 82 is seen to be a long, slender tube concentric with mud anchor 46 and spaced therefrom by a barrel guide 90 which engages the middle portion 60 of mud anchor 46 above bore grouping 56. Barrel 82 includes a precision bored inner surface 92, an open upper end 94 and an open lower end 96. Upper end 94 is connected to mounting assembly 84 such that it opens into tubing string 42. Two standing ball and seat check valves 100 and 102 are mounted in series at the lower end 96 of barrel 82. Such ball and seat check valve combinations allow fluid to flow through the valve when there is a pressure differential across it such that the fluid pressure acting on the seat and bottom of the ball is greater than the fluid pressure acting on the top of the ball. When the pressure differential occurs in the opposite direction, the ball is biased against the seat to thereby prevent fluid flow through the valve. Thus, fluid can flow upwardly through check valves 100 and 102 into barrel 82 but is restricted from flowing downwardly from barrel 82 through check valves 100 and 102.

Figure 3:
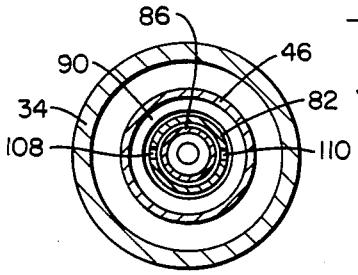
FIG. 3 is a cross-sectional view taken along line 3—3 of FIG. 2.

A tubular gas anchor 104 having a plurality of lateral bores 106 drilled in its side wall is threadably connected with the lower one 102 of standing check valves 100 and 102. Gas anchor 104 functions to lower the inlet to down hole pump 80 and to strain the liquid entering pump 80. Looking additionally to FIG. 3, two lateral degassing ports 108 and 110 are drilled in barrel 82 between upper and lower ends 94 and 96. Returning to FIG. 2, degassing ports 108 and 110 open into an upper annular chamber 112 located between barrel 82 and mud anchor 46 above barrel guide 90. A lower annular chamber 114 can be seen to be located between barrel 82 and mud anchor 46 below barrel guide 90. Formation fluid within annular chamber 76 flows into lower annular chamber 114 through bore grouping 56 and into upper annular chamber 112 through bore grouping 54. It may be recalled that the inlet to rod pump 80 can be reached only through gas anchor 104 and only fluid in lower chamber 114 can enter gas anchor 104. Fluid in upper annular chamber 112 is restricted from moving downwardly into chamber 114 by barrel guide 90.

The space above the top one 100 of standing check valves 100 and 102 which is encompassed by precision bored inner surface 92 of barrel 82 defines a barrel chamber 120 which receives plunger 86. Plunger 86 is seen to be a long, slender tubular member having a precision machined outer surface 126. This permits clearance of between 0.001 and 0.002 inches to exist between outer surface 126 and barrel inner surface 92. Two travelling ball and seat type check valves 128 and 130 are mounted in series in the lower end 124 of plunger 86. A tapered surface 122 defines the upper end of plunger 86. This surface 122 has a plurality of openings 140 and is joined to the bottom section 132 of rod string 88. The space within the cylindrical inner surface 136 of plunger 86 between the top one 128 of travelling check valves 128 and 130 and tapered surface 122 defines a plunger chamber 138. Plunger chamber 138 is in fluid communication with barrel chamber 120 and tubing string 42 through openings 140. This enables fluid within plunger chamber 138 to be moved up tubing string 42.

Reciprocation of yoke plate 24 and rod string 88 by stroking device 10 reciprocates and operates plunger 86 in barrel 82 to lift formation fluid through tubing string 42. Looking again to FIG. 2, when yoke plate 24 and rod string 88 are raised, plunger 86 moves upwardly in barrel 82. As plunger 86 moves upwardly, the weight of the column of formation fluid in tubing string 24, the portion of barrel chamber 120 above the plunger and plunger chamber 138 acts on top of travelling check valves 128 and 130 to close them. Consequently, the weight of the fluid column is supported by rod string 88. Additionally, as plunger 86 moves upwardly the pressure in the space 142 in that portion of barrel chamber 120 between the bottom 144 of plunger 86 and the top of standing check valve 100 falls below formation pressure. This creates a pressure differential across standing check valves 100 and 102 which will enable formation fluid in lower annular chamber 114 to flow into gas anchor 104 and upwardly through valves 100 and 102 into space 142. The fluid that is received in space 142 will be moved up tubing string 24 during the next stroke of plunger 86. Hence, space 142 acts as a pumping chamber. Because of the reduced pressure in chamber 142, outgassing of some of the light ends in solution in the formation fluid can occur. These outgassed light ends and free gas in the fluid tend to rise to the top of pumping chamber 142 adjacent plunger bottom 144.

Figure 4:
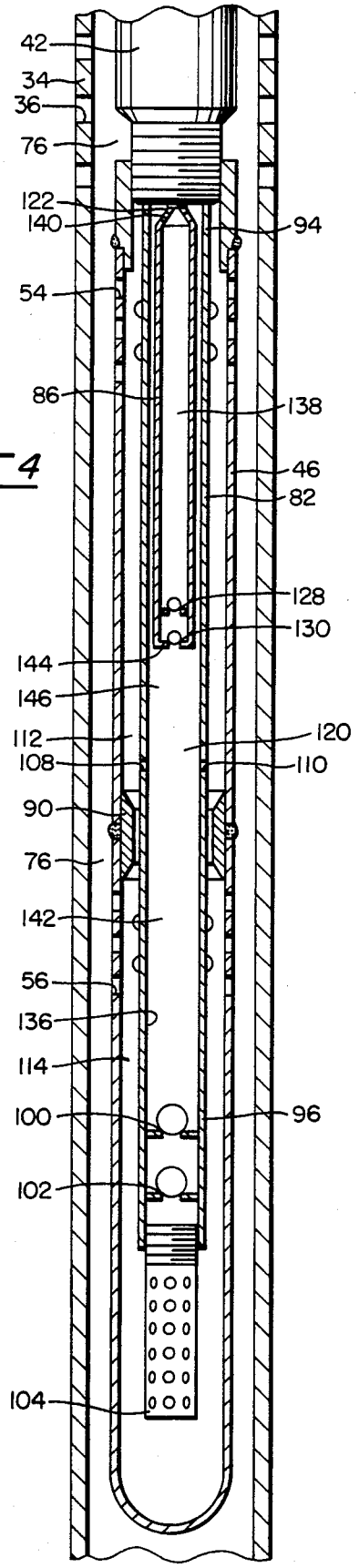
FIG. 4 is a view similar to FIG. 2 portraying gaseous fluids being expelled from the pump apparatus.

At the top of its stroke plunger 86 is spaced from plunger ports 108 and 110 as seen in FIG. 4. The bottom 144 of plunger 86 then cooperates with the inner surface 136 of barrel 82 to define a degassing zone 146 in the top of pumping chamber 142 which extends downwardly through and is adjacent degassing ports 108 and 110. Thus, the free gas and the outgassed light ends occupy a portion of degassing zone 146. The volume of zone 146 may be approximately 20% of the maximum volume of pumping chamber 142. It is apparent that the volume of pumping chamber 142 is at a maximum value when plunger 86 is at the end of its upward stroke in barrel chamber 120 and is at a minimum value when plunger 86 is at the end of its downward stroke in barrel chamber 120.

As yoke plate 24 and rod string 88 are lowered, plunger 86 moves downwardly in barrel chamber 120 through degassing zone 146 as shown in FIG. 4. This movement causes the pressure in pumping chamber 142 to increase above formation pressure resulting in a pressure differential across standing check valves 100 and 102 which forces the valves closed. Although the pressure in pumping chamber 142 is above formation pressure, it is below the pressure of the fluid in the tubing string because degassing ports 108 and 110 are open and provide fluid communication between chamber 142 and fluid at formation pressure in annular chamber 76. Consequently, the weight of the fluid in tubing string 142 maintains travelling check valves 128 and 130 in closed orientation as plunger 86 traverses degassing zone 146. Because of the increased pressure in pumping chamber 142, any gases or other fluid in degassing zone 146 are compressed and expelled under pressure through degassing ports 108 and 110 into upper annular chamber 112. Ports 108 and 110 have a small diameter selected to cause the expelled fluid to flow through them at a relatively high velocity. This high velocity flow is thought to agitate fluid in degassing zone 146 and pumping chamber 142 to cause further outgassing from the formation fluid to thereby ensure that only liquid remains in that portion of pumping chamber 142 below degassing ports 108 and 110.

Figure 5:
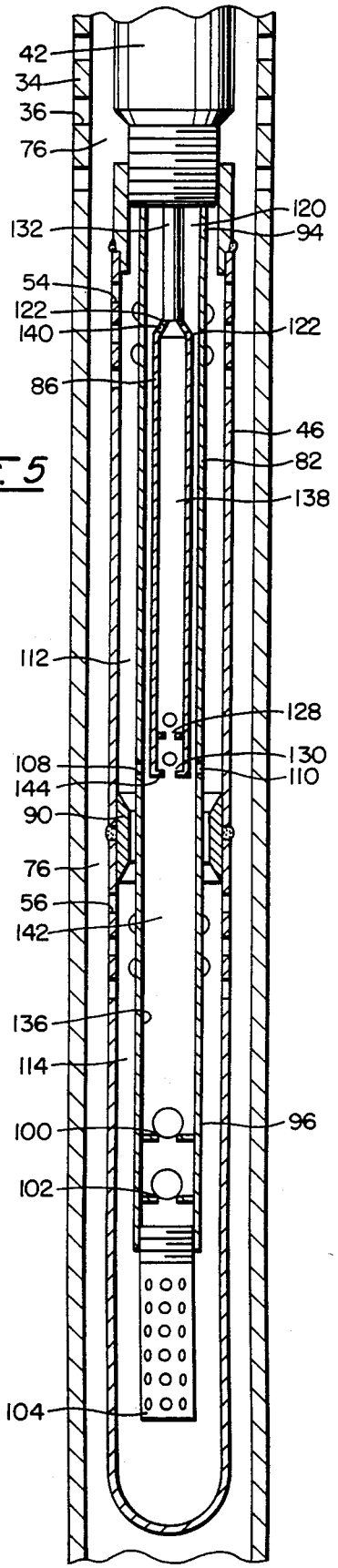
FIG. 5 is a view similar to FIG. 2 showing the operation of the pump apparatus subsequent to the expulsion of the gaseous fluids.

When plunger 86 completes its downward traversal of degassing zone 146, degassing ports 108 and 110 are covered, i.e. substantially blocked by plunger 86 as shown in FIG. 5. Should pumping chamber 142 then be filled with liquid, the weight of the fluid column in tubing string 42 will be applied to the top of standing check valves 100 and 102 to close them and thereby transfer the weight of the fluid column to tubing string 42. As this occurs, travelling check valves 128 and 130 will open and remain in that state as plunger 86 traverses the remainder of pumping chamber 142. Standing check valves 100 and 102 remain closed and tubing string 42 supports the weight of the fluid column in tubing string 42 until plunger 86 begins to move upwardly in pumping chamber 142 as described previously in connection with FIG. 2.

Looking again to FIG. 4, gases which are expelled through degassing ports 108 and 110 rise in upper annular chamber 112 and move through bore grouping 54 into annular chamber 76. These gases commingle with formation fluid which moves downwardly in chamber 76 towards bore grouping 56 in order to enter pumping chamber 142. This commingling encourages the outgassing of any gases which are marginally in solution in the formation fluid before the fluid enters pump 80. This reduces the volume of gas which will be outgassed in pumping chamber 142 and ensures that the volume of outgassed fluid will not exceed the volume of degassing zone 146 and that only liquid will occupy the space beneath degassing ports 108 and 110. Additionally, any gas within annular chamber 76 can be easily recovered at well head 12 for use or sale. Locating mud anchor 46 below openings 36 which admit formation fluid into well 14 has an advantage in addition to enabling gases expelled from degassing ports 108 and 110 to commingle with formation fluid entering pump 80. It also lowers the intake of down hole pump 80 to thereby increase the hydrostatic pressure acting on fluid entering the pump and reduce the amount of outgassing which occurs from the fluid.

In order to determine the effect of the pumping apparatus and the method of the invention on well production, conventional pumping components were removed from five producing gas-oil wells and replaced with apparatus which embodied the subject pumping system. These wells were located in Muskingum County, Ohio, which is located within the Clinton formation, and had been in production for approximately one year before the conventional pumping implements were replaced. The oil well production table below summarizes the performance of the five wells before and after this revision of the pumping systems of the wells.

OIL WELL PRODUCTION

| | WELL 1 | WELL 2 | WELL 3 | WELL 4 | WELL 5 |
|---|---|---|---|---|---|
| Conventional Pump Apparatus | 5.88 inches per day which is equal to 4.82 barrels per day | 2.13 inches per day which is equal to 1.74 barrels per day | 6.40 inches per day which is equal 5.24 barrels per day | 6.48 inches per day which is equal to 4.13 barrels per day | 8.15 inches per day which is equal to 6.68 barrels per day |
| Revised Pump Apparatus | 16.90 inches per day which is equal to 13.85 barrels per day | 20.40 inches per day which is equal to 16.72 barrels per day | 5.73 inches per day which is equal to 4.69 barrels per day | 6.75 inches per day which is equal to 5.53 barrels per day | 12.61 inches per day which is equal to 10.34 barrels per day |
| Net Increase in Production Following Installation of Revised Pump Apparatus | 11.02 inches per day which is equal to 9.03 barrels per day | 18.27 inches per day which is equal to 14.98 barrels per day | −.67 inches per day which is equal to −.54 barrels per day | .27 inches per day which is equal to .22 barrels per day | 4.46 inches per day which is equal to 3.65 barrels per day |
| Percentage Increase in Production | 187% | 857% | (10%) | 4% | 54% |

In the table, production is expressed in terms of inches per day and barrels per day. Crude oil production in the Clinton formation is commonly measured in terms of inches per day. This measurement refers to the amount of liquid which is deposited in a storage tank having a capacity of 100 barrels. One inch of liquid within the tank equals approximately 0.82 barrels of liquid. The theoretical maximum displacement of the five pumps if they were continuously pumping liquid was approximately 24 inches per day. The inches per day values in the table were calculated by dividing the total number of inches per month by the number of days in the month.

Looking to the table, it may be observed that wells 1, 2, and 5 experienced dramatically increased production rates with the installation of the revised pumping system and method. In fact, the production of well 2 was almost 85 percent of the theoretical maximum displacement of the pumping apparatus. Although, well 3 showed a small decrease in production following installation of the revised apparatus, an equipment problem resulted in virtually no production from well 3 for one of the months included in the four month measuring period. If the production rate of well 3 was adjusted to exclude the time the pumping apparatus was idle from the measuring period it would be seen that production of this well increased slightly following installation of the revised apparatus.

It should be noted that the measurements of the production of wells 1 through 4 subsequent to the installation of the revised pump apparatuses were taken in the months of October through January and that such measurements for well 5 were taken in the months of December and January. Thus, these measurement periods included at least two winter months which are especially troublesome for oil production. During these months it sometimes becomes necessary to shut wells down for several days at a time because trucks are unable to access storage tanks and they become full because water in the pumping systems freezes which renders them inoperative. Consequently, the production rates subsequent to the installation of the revised pump apparatuses given in the table are quite conservative.

Thus, it will be appreciated that the production rates of the five wells increased substantially subsequent to the installation of the revised systems despite the fact the measurement period of the production rates included some winter months.

From the above it can be seen that in conventional pumping apparatuses any free gas or outgassed light ends which are within the pumping chamber must be forced up the tubing string. To accomplish this the gas must be compressed to the pressure of the fluid in the string. If the pump cannot compress the gas to that required pressure, the pump becomes gas locked and operates without displacing any formation fluid. Even if the pump can compress the gas to the required pressure and move it up the tubing string gas in the tubing string seriously degrades the efficiency of the pumping process. On the other hand, in a pumping apparatus according to the invention any free gas or outgassed light ends which are within the pumping chamber can be removed during normal pumping operations. Consequently, the pump apparatus cannot become gas locked and only liquid has to be moved up the tubing string which greatly enhances the efficiency of the pumping process.

Since certain changes may be made to the above-described system, method, and apparatus without departing from the scope of the invention herein, it is intended that all matter contained in the description thereof or shown in the accompanying drawings shall be interpreted as illustrative and not in a limiting sense.

I claim:

1. In a gas-oil well production system for pumping formation fluid wherein a down hole pump is provided having a barrel including a barrel fluid inlet, a barrel fluid outlet, a barrel chamber, and a plunger mounted in said barrel chamber having a plunger chamber, said plunger being reciprocally driven between an upper terminal position at the end of the plunger upstroke and a lower terminal position at the end of the plunger downstroke, the method for removing developed gaseous fluids in the formation fluid from the barrel chamber which comprises the steps of:

drawing formation fluid into said barrel chamber during said plunger upstroke;

providing gas port means in said barrel;

expelling said developed gaseous fluids from said barrel chamber through said gas port means during the occurrence of that portion of said plunger downstroke from said upper terminal position to said gas port means; and substantially blocking said gas port means and moving formation fluid into said plunger chamber during the occurrence of that portion of said plunger downstroke from below said gas port means to said lower terminal position.

2. The method of claim 1 further comprising the step of substantially blocking said gas port means during the occurrence of that portion of said plunger upstroke from said lower terminal position to immediately below said gas port means.

3. The method of claim 1 wherein said gas port means is provided with a diametral extent which causes the expulsion of said developed gaseous fluids to occur at substantially high velocity.

4. The method of claim 1 wherein said down hole pump is provided with a mud anchor for receiving said barrel and a barrel guide positioned between said barrel and said mud anchor.

5. The method of claim 4 wherein said barrel guide is provided at a position which causes said expelled gaseous fluids to move upwardly externally of said barrel.

6. The method of claim 4 wherein said mud anchor is provided with a first fluid communication means for conveying formation fluid to said barrel inlet during said plunger upstroke.

7. The method of claim 6 wherein said mud anchor is provided with a second fluid communication means for conveying said expelled gaseous fluids to the outside of said mud anchor during the occurrence of that portion of said plunger downstroke from said upper terminal position to said gas port means.

8. A gas-oil well production system in which a down hole pump is operated by a surface stroking device to lift formation fluid in a well through a tubing string located within a casing which comprises:

a barrel having a barrel wall, a barrel fluid inlet, and a barrel fluid outlet connectable in fluid communication with said tubing string;

said barrel wall, said barrel fluid inlet and said barrel fluid outlet cooperating to define a barrel chamber;

a plunger mounted for reciprocation within said barrel chamber;

means for connecting said plunger to said surface stroking device whereby said plunger is driven between an upper terminal position at the end of the plunger upstroke and a lower terminal position at the end of the plunger downstroke;

gas port means in said barrel at a location between said barrel fluid inlet and said barrel fluid outlet and positioned a predetermined distance below said plunger when said plunger is at said upper terminal position for providing for gas flow communication with said casing and establishing a degassing zone wherein developed gaseous fluids in said formation fluid are collected between said plunger and said gas port means, whereby said developed gaseous fluids are expelled from said degassing zone during that portion of said plunger downstroke from said upper terminal position to said gas port means.

9. The gas-oil production system of claim 8 wherein said gas port means are so located as to be substantially blocked by said plunger during that portion of said plunger downstroke from said gas port means to said lower terminal position.

10. The gas-oil production system of claim 8 further comprising a mud anchor which encases said barrel to form an outer fluid chamber between said barrel and said mud anchor; and barrel guide means positioned in said outer fluid chamber between said mud anchor and said barrel intermediate said gas port means and said barrel fluid inlet for restricting the movement of said expelled gaseous fluids to an upward direction in said outer fluid chamber, thereby preventing said expelled gaseous fluids from entering said pump inlet.

11. The gas-oil production system of claim 10 in which the lowermost extending end of said mud anchor is closed; and including a first formation fluid communication means formed in said mud anchor intermediate said barrel guide means and said closed end for providing formation fluid ingress to said barrel fluid inlet.

12. The gas-oil production system of claim 11 which further comprises second formation fluid communication means formed in said mud anchor intermediate said barrel guide means and said barrel fluid outlet for conveying said expelled gaseous fluid from said outer fluid chamber into said casing.

13. The gas-oil production system of claim 12 which further comprises:

formation fluid inlet means formed in said casing; and wherein said second formation fluid communication means are positioned below said formation fluid inlet means such that fluid exhausted from said second formation fluid communication means commingles with formation fluid which moves downwardly from said formation fluid inlet means toward said first formation fluid communication means.

14. A down hole pump for lifting fluid in a well which comprises:

a barrel having a barrel wall, a barrel fluid inlet and a barrel fluid outlet;

said barrel wall, said barrel fluid inlet and said barrel fluid outlet cooperating to define a barrel chamber;

a plunger mounted for reciprocation within said barrel chamber and moveable between an upper terminal position at the end of the plunger upstroke and a lower terminal position at the end of the plunger downstroke; and gas ports in said barrel positioned between said barrel fluid inlet and said barrel fluid outlet and spaced a predetermined distance from said plunger when in said upper terminal position to establish a degassing zone, said spacing positioning said ports such that said plunger effects a substantial blockage thereof when said plunger is below said degassing zone.

15. The down hole pump of claim 14 which further comprises a mud anchor having a closed end and which encases said barrel, whereby an outer fluid chamber is established between said muc anchor and said barrel; and a barrel guide positioned in said outer fluid chamber between said gas port means and said barrel fluid inlet wherein gas fluid exhausted from said gas port means is blocked from said gas port means is blocked from said barrel fluid inlet.

16. The down hole pump of claim 15 which further comprises a first fluid communication means in said mud anchor between said barrel guide and said closed end which effects conveyance of formation fluid from outside said mud anchor to said barrel fluid inlet.

17. The down hole pump of claim 16 which further comprises a second fluid communication means in said mud anchor between said barrel guide and said barrel fluid outlet.

18. The down hole pump of claim 16 which further comprises a gas anchor connectable in fluid communication with said barrel inlet and wherein said gas anchor includes fluid passage means for conveying formation fluid from said outer fluid chamber to said barrel fluid inlet.

* * * * *